US007347710B2

(12) United States Patent
Ohtaka et al.

(10) Patent No.: US 7,347,710 B2
(45) Date of Patent: Mar. 25, 2008

(54) ELECTRIC WIRE CONNECTOR HAVING A LOCK SECURING MECHANISM

(75) Inventors: Kazuto Ohtaka, Shizuoka (JP); Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/727,701

(22) Filed: Mar. 28, 2007

(65) Prior Publication Data

US 2007/0275589 A1 Nov. 29, 2007

(30) Foreign Application Priority Data

May 26, 2006 (JP) ..... 2006-147254

(51) Int. Cl.
*H01R 13/627* (2006.01)

(52) U.S. Cl. ..... 439/352; 439/357

(58) Field of Classification Search ..... 439/352, 439/354, 357

See application file for complete search history.

(56) References Cited

U.S. PATENT DOCUMENTS

| | | | | |
|---|---|---|---|---|
| 4,657,331 | A * | 4/1987 | Coldren | 439/571 |
| 5,234,356 | A * | 8/1993 | Maejima et al. | 439/352 |
| 5,246,380 | A * | 9/1993 | Kodama | 439/354 |
| 5,913,703 | A * | 6/1999 | Suzuki et al. | 439/701 |
| 6,068,507 | A * | 5/2000 | Popa | 439/489 |
| 6,102,718 | A * | 8/2000 | Kumakura et al. | 439/157 |
| 2002/0173197 | A1* | 11/2002 | Endo | 439/489 |
| 2003/0077936 | A1* | 4/2003 | Tsuji et al. | 439/489 |
| 2003/0166358 | A1 | 9/2003 | Yamaoka et al. | 439/489 |
| 2003/0186579 | A1 | 10/2003 | Saka et al. | 439/489 |
| 2005/0042907 | A1* | 2/2005 | Komiyama | 439/296 |
| 2006/0089039 | A1* | 4/2006 | Caveney et al. | 439/352 |

FOREIGN PATENT DOCUMENTS

| | | |
|---|---|---|
| EP | 1 156 557 | 11/2001 |
| GB | 2 429 851 | 3/2007 |
| JP | 2003-157932 | 5/2003 |

OTHER PUBLICATIONS

Office Action from the Intellectual Property Office of the United Kingdom mailed Jul. 30, 2007 (4 pages).

* cited by examiner

*Primary Examiner*—Tulsidas C. Patel
*Assistant Examiner*—Harshad C Patel
(74) *Attorney, Agent, or Firm*—Kratz, Quintos & Hanson, LLP

(57) ABSTRACT

A connector includes a male housing, a locking arm to be engaged with a locking projection of a mating connector, a lock securing member, and a lock releasing portion. The lock securing member is mounted movably on the connector. The lock releasing portion is mounted on the lock releasing portion. The lock releasing portion releases an engagement between the locking arm and the locking projection in conjunction with a movement of the lock securing member while the locking projection and the locking arm are completely engaged with each other.

4 Claims, 8 Drawing Sheets

ELECTRIC WIRE CONNECTOR HAVING A LOCK SECURING MECHANISM

CROSS REFERENCE TO RELATED APPLICATIONS

This application is on the basis of Japanese Patent Application No. 2006-147254, the contents of which are hereby incorporated by reference.

BACKGROUND OF THE INVENTION

1. Field of the Invention

This invention relates to a connector having a lock securing mechanism used for connecting electric wires or the like.

2. Description of the Related Art

A wiring harness used in a vehicle includes a connector. The connector includes a box-shaped or tube-shaped connector housing, and a terminal fitting received in the connector housing and attached to an end of the electric wire.

Conventionally, in such a connector, for knowing whether the connector is fully engaged with a mating connector or not, various lock securing mechanisms are suggested (for example, Patent Document 1 discloses a connector having a lock securing mechanism). The connector having the lock securing mechanism disclosed by the Patent Document 1 includes a connector housing, a terminal fitting, and a lock securing member. A locking arm is mounted on the connector housing. The locking arm is once resiliently deformed, then returns to a neutral position to be engaged with the mating connector. A center part in a longitudinal direction of the locking arm extends to the connector housing, and an end near the mating connector of the locking arm is engaged with the engaging portion.

The lock securing member is movably attached to the connector housing in between a regulating position where the resilient deformation of the locking arm is regulated, and an allowing position where the resilient deformation of the locking arm is allowed. When the locking arm is deformed to the neutral position, the lock securing member is movable between the regulating position and the allowing position without interfering with the locking arm. When the locking arm is resiliently deformed, the lock securing member interferes with the locking arm and a movement from the allowing position to the regulating position is regulated.

The connector having the lock securing mechanism positions the lock securing member at the allowing position and is connected to the mating connector. Then, after the connector is connected to the mating connector, whether the connector is fully connected to the mating connector or not is known by knowing whether the lock securing member is movable toward the regulating position or not.

Further, after the connector having the lock securing mechanism is fully connected to the mating connector, and positions the lock securing member at the allowing position, the connection between the connector and the mating connector is released by releasing an engagement between the one end of the locking arm and the engaging portion. Pushing the other end away from the mating connector of the connector toward the connector housing releases the engagement.

[Patent Document 1] Japanese Published Patent Application No. 2003-157932

According to the conventional connector having the lock securing mechanism, when the connection with the mating connector is released, the other end of locking arm is pressed to release the engagement between the one end of the locking arm and the engaging portion. Therefore, a bending space where the other end of the locking arm can be bent is needed. Further, for securing mechanical strength of the locking arm against the pushing force and operability of the other end of the locking arm, the locking arm tends to be large. Thus, according to the conventional connector having the lock securing mechanism, because the bending space is needed, and the locking arm becomes larger, the connector itself tends to be large.

Accordingly, an object of the present invention is to provide a connector having a lock securing mechanism which can be downsized.

SUMMARY OF THE INVENTION

For solving the problem, according to the present invention, there is provided a connector including:

a connector housing for receiving terminal fittings;

a locking arm extended to the connector housing, an end of which is engaged with an engaging portion of a mating connector;

a lock securing member attached movably to the connector housing, said lock securing member regulating a movement thereof until the engaging portion and the locking arm are fully engaged with each other when the connector is connected to the mating connector, and allowing the movement after the engaging portion and the locking arm are fully engaged with each other, and a lock releasing portion mounted on the lock securing member for releasing the engagement between the locking arm and the engaging portion by moving the lock securing member in a direction opposite to a direction of moving the locking arm and the engaging portion to be fully engaged with each other.

Preferably, the lock releasing portion includes a releasing portion disposed at a position invadable between an one end of the locking arm and the connector housing when the lock securing member is moved in the direction opposite to the direction of moving the locking arm and the engaging portion to be fully engaged with each other.

Preferably, the lock releasing portion includes a pair of the releasing portions disposed at a position where the locking arm is positioned between the releasing portions.

Preferably, the lock securing member includes a main body formed in a tube shape for receiving the connector housing and having notches for positioning the locking arm inside of the main body, and the releasing portions are respectively disposed on inner walls facing each other of the notches.

According to the present invention as described above, the lock releasing portion is formed on the lock securing member for releasing the engagement between the other end of the locking arm and the engaging portion in conjunction with a movement of the lock securing member. Therefore, only moving the lock securing member releases the connection to the mating connector.

According to the present invention described above, the lock releasing portion includes a releasing portion invadable between the one end of the locking arm and the connector housing when the lock securing member is moved. Therefore, moving the lock securing member surely releases the engagement between the one end of the locking arm and the engaging portion.

According to the present invention described above, the lock releasing portion includes a pair of the releasing portions disposed at a position where the locking arm is positioned between the releasing portions. Therefore, the releasing portion invading between one end of the locking arm and the connector housing surely releases the engagement between the one end of the locking arm and the engaging portion.

According to the present invention described above, the releasing portion is disposed at inner walls of the notches of the tube-shaped main body of the lock securing member. Therefore, structures of the lock releasing portion and the lock securing member can be simple.

These and other objects, features, and advantages of the present invention will become more apparent upon reading of the following detailed description along with the accompanied drawings.

DETAILED DESCRIPTION OF THE PREFERRED EMBODIMENTS

Figure 1:
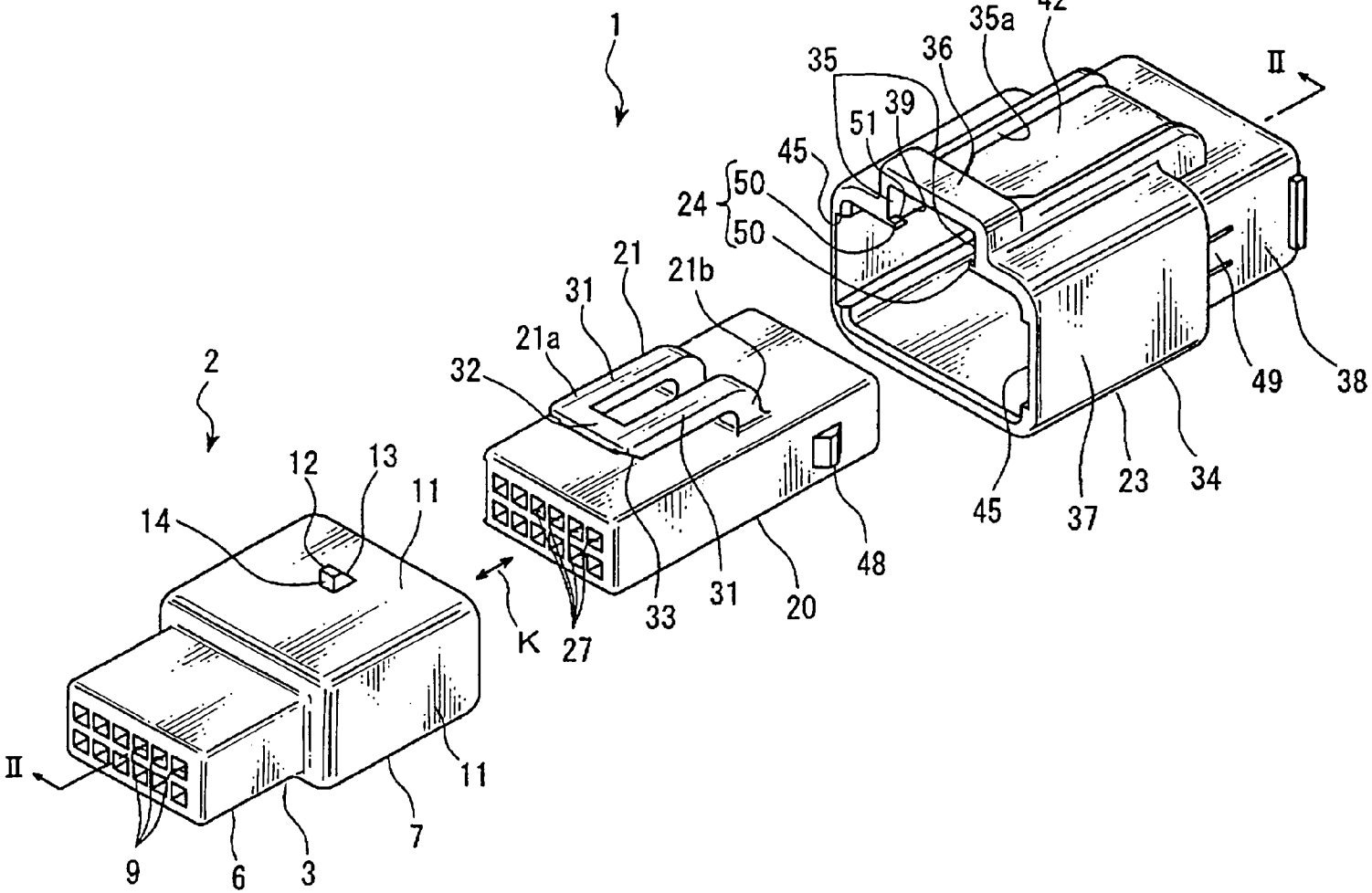
FIG. 1 is an exploded perspective view showing a main part of a connector according to a first embodiment of the present invention.
Figure 2:
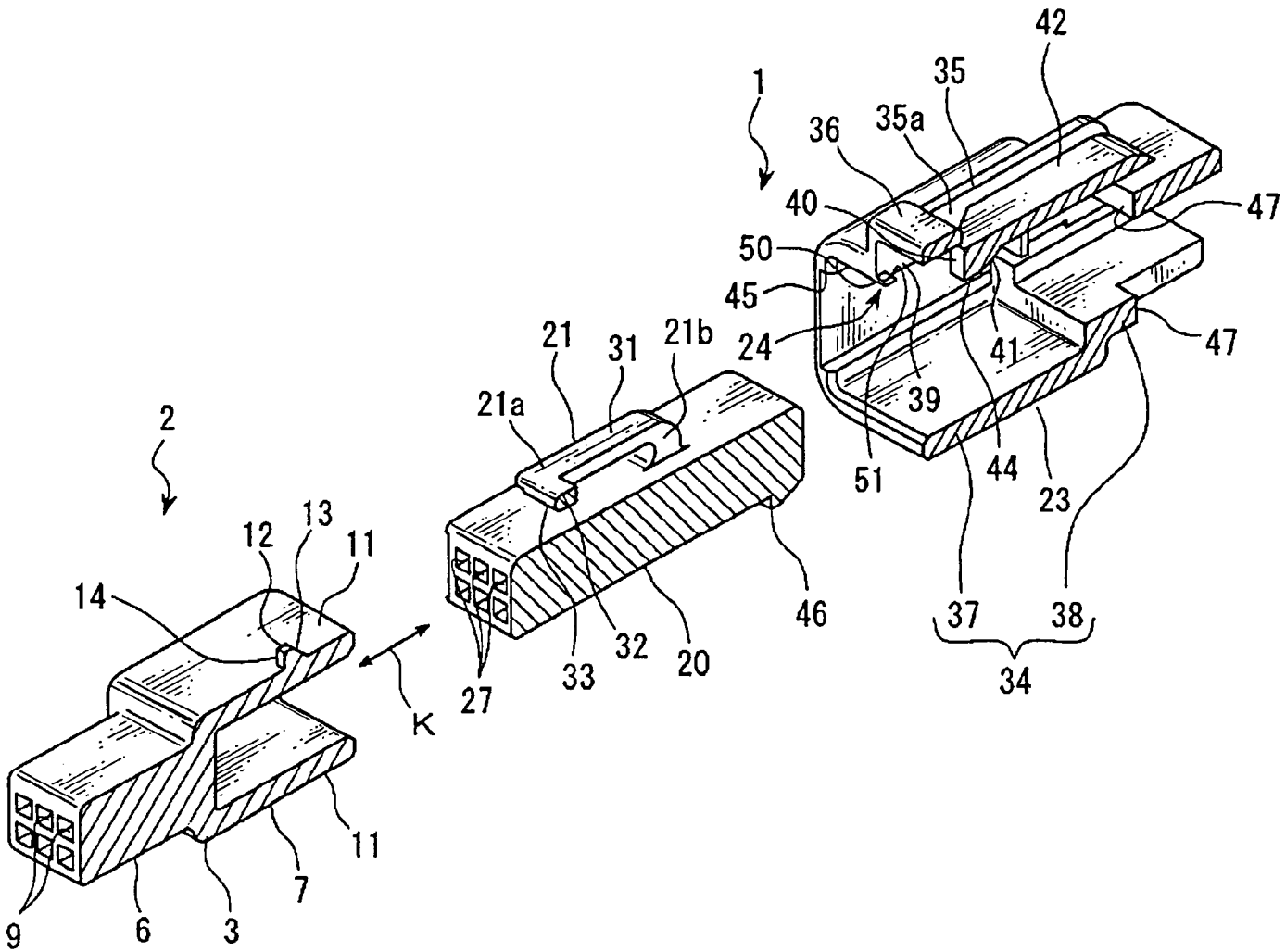
FIG. 2 is a perspective view showing a section taken on line II-II in FIG. 1.

A connector having a lock securing mechanism according to a first embodiment of the present invention will be explained with reference to FIGS. 1 to 12. A connector 1 shown in FIG. 1 is connected to a mating connector 2 shown in FIGS. 1 to 12.

As shown in FIGS. 1 to 12, the mating connector 2 includes a female type connector housing 3 (hereunder referred to as "female housing") and a not shown male type terminal fitting (hereunder referred to as "male terminal").

The female housing 3 is made of synthetic resin. As shown in FIGS. 1 to 12, the female housing 3 includes a main body 6 receiving a plurality of male terminals, and a cover 7. Incidentally, in this description, a connector hosing formed in a tubular shape and an inside of which a male housing 20 is inserted is referred to as "female connector housing".

The main body 6 includes terminal receiving chambers 9 disposed parallel to each other. Each of terminal receiving chambers 9 extends straight and receives the male terminal. A fastening arm projecting from an inner wall of the terminal receiving chamber 9 and fastening the male terminal is formed on the terminal receiving chamber 9.

The cover 7 is formed in a box shape and includes peripheral walls 11 extending from outer edges of the main body 6. Namely, the cover 7 extends from the main body 6. Edges of the peripheral walls 11 away from the main body 6 form an opening for receiving the later-described male housing 20. A locking projection 12 as an engaging portion is formed on one of the peripheral walls 11 positioned at a top of the cover 7. The locking projection 12 is formed in a convex shape from an outer wall of the peripheral wall 11.

A taper wall 13 facing the connector 1 and a vertical wall 14 away from the connector 1 are formed on the locking projection 12. The taper wall 13 is so sloped to approach the peripheral wall 11 as the taper wall 13 approaches the connector 1 in a connecting direction of connecting the connectors 1, 2 (shown by an arrow K in FIG. 3). Incidentally, the connecting direction means directions where the connectors 1, 2 approach or separate from each other when the connectors 1, 2 are connected or released. The vertical wall 14 is formed in a plane shape in a direction perpendicular to the connecting direction. The female housing 3 is a mating connector housing described in this description.

The male terminal is made by stamping and folding a plate metal. The male terminal integrally includes a wire connecting portion and an electric contact portion extending from the wire connecting portion. An electric wire is attached to the wire connecting portion, and a core wire of the electric wire is electrically connected to the wire connecting portion. The electric contact portion is formed in a bar shape. The electric contact portion is inserted into a later-described female terminal and electrically connected to the female terminal.

The male terminal is attached to the female housing 3 in a state that the electric contact portion is disposed inside the cover 7, and the wire connecting portion is received in the terminal receiving chambers 9. The male terminal is a mating terminal fitting in this description.

As shown in FIGS. 1 to 12, the connector 1 includes a male-type connector housing 20 (hereunder referred to as "male housing"), a locking arm 21, a not-shown female-type terminal fitting (hereafter referred to as "female terminal"), a lock securing member 23, and a lock releasing portion 24.

The male housing 20 is made of synthetic resin. As shown in FIGS. 1 to 12, the male housing 20 is formed in a box shape having a plurality of terminal receiving chambers 27 receiving female terminals. Incidentally, in this description, a connector housing to be inserted into a tube-shaped female housing 3 is referred to as a male-type connector housing. The male housing 20 is a connector housing described in this description.

The terminal receiving chambers 27 are disposed parallel to each other. Each of the terminal receiving chambers 27 extends straight. Openings are disposed through outer surfaces of the male housing 20 at both ends of the terminal receiving chambers 27 in a longitudinal direction. The terminal receiving chambers 27 receive female terminals. A not-shown fastening arm for fastening the female terminal is disposed on an inner wall of each terminal receiving chamber 27. The male housing 20 is inserted into the cover 7 so that the terminal receiving chambers 27 and the terminal receiving chambers 9 of the female housing 3 extend to each other.

The locking arm 21 extends to an outer wall of the male housing 20. The locking arm 21 includes a pair of supporting arms 31, and a locking beak 32. Each of the supporting arms 31 is formed in a bar shape extending straight. A longitudinal direction of the supporting arm 31 is parallel to the connecting direction K of the connectors 1, 2.

The pair of supporting arms 31 is parallel to each other, and disposed with a gap. One end of the supporting arm 31 extends to a middle part of the male housing 20 in the connecting direction K, and the other end of the supporting arms 31 is a free end disposed near the connector 2. The locking beak 32 connects the other ends of the pair of supporting arms 31.

The locking projection 12 is positioned between the pair of supporting arms 31 and the locking beak 32. One end 21*a* of the locking arm 21 near the mating connector 2 is engaged with the locking projection 12. Further, the other end 21*b* of the locking arm 21 away from the mating connector 2 extends to the outer wall of the male housing 20. When the locking arm 21 is engaged with the locking projection 12, the locking beak 32 contacts the locking projection 12.

Then, the locking beak 32 of the locking arm 21 runs on the locking projection 12, and the one end 21*a* of the locking arm 21 is once resiliently deformed toward an outside of the male housing 20. When the locking beak 32 runs over the locking projection 12, the locking projection 12 is positioned between the supporting arms 31 and the locking beak 32 owing to a resilient force so that the locking arm 21 is engaged with the locking projection 12.

Further, a taper wall 33 is formed at a tip end of the one end 21*a* of the locking arm 21. The taper wall 33 slopes in a direction outside of the male housing 20 relative to the connecting direction K as the taper wall 33 approaches the connector 2.

The female terminal is made by stamping and folding a plate metal. The female terminal integrally includes a wire connecting portion and an electric contact portion extending from the wire connecting portion. An electric wire is attached to the wire connecting portion, and a core wire of the electric wire is electrically connected to the wire connecting portion. The electric contact portion is formed in a tubular shape. The electric contact portion is inserted into the male terminal and electrically connected to the male terminal.

The lock securing member 23 is made of insulating synthetic resin. The lock securing member 23 includes a main body 34, a pair of standing walls 35, a connecting wall 36, and a detecting arm 42 for detecting an incomplete connection. The main body 34 integrally includes a first tubular portion 37 and a second tubular portion 38, and is totally formed in a tubular shape. The first and second tubular portions 37, 38 are arranged in series. The first tubular portion 37 is bigger than the second tubular portion 38.

The main body 34 is attached to the male housing 20 by receiving the male housing 20 at an inside thereof. Further, the main body 34, namely, the lock securing member 23 is slidably attached to the male housing 20 along a longitudinal direction of the terminal receiving chambers 27 of the male housing 20, namely, the connecting direction K.

Further, notches 39 are formed on the main body 34 and extend in the connecting direction K. Each notch 39 is formed on a full length of the first tubular portion 37 of the main body 34 in the connecting direction K, and extends straight in the connecting direction K.

The pair of standing walls 35 extends vertically from inner edges of the notches 39 facing in a direction perpendicular to the connecting direction K toward an outer circumference of the main body 34, namely, the lock securing member 23. The connecting wall 36 connects the ends of the standing walls 35 near the mating connector 2 when the main body 34, namely, the lock securing member 23 is attached to the male housing 20. The connecting wall 36 is formed flat along an outer wall of the first tubular portion 37 of the lock securing member 23.

The detecting arm 42 for detecting an incomplete connection is formed in a band shape of which longitudinal direction is in the connecting direction K, and disposed between the notches 39, namely, the pair of standing walls 35. An one end of the detecting arm 42 away from the mating connector 2 extends to an outer wall of the second tubular portion 38, and the other end of the detecting arm 42 is disposed nearer the mating connector 2 than the one end thereof. A detecting projection 44 for detecting an incomplete connection projecting toward an inside of the lock securing member 23 is formed on the other end of the detecting arm 42.

An orthogonal wall 40 facing the mating connector 2 and a slope wall 41 near the main body 34, namely, the lock securing member 23 are formed on the detecting projection 44. The orthogonal wall 40 is formed flat in a direction perpendicular to the connecting direction K. The slope wall 41 slopes in a direction outside of the main body 34, namely, the lock securing member 23 relative to the connecting direction K as the slope wall 41 gets away from the connector 2.

The lock securing member 23 is attached to the male housing 20 by receiving the male housing 20 in the main body 34 in a state that the other end, on which the detecting projection 44 of the detecting arm 42 is formed, faces the mating connector 2. Further, the lock securing member 23 is attached to the male housing 20 so that the detecting arm 42 is overlapped with the locking arm 21.

The lock securing member 23 is movably attached to the male housing 20 in the connecting direction K between a regulating position (fully connecting position) and an allowing position (a before-connecting position).

Figure 8:
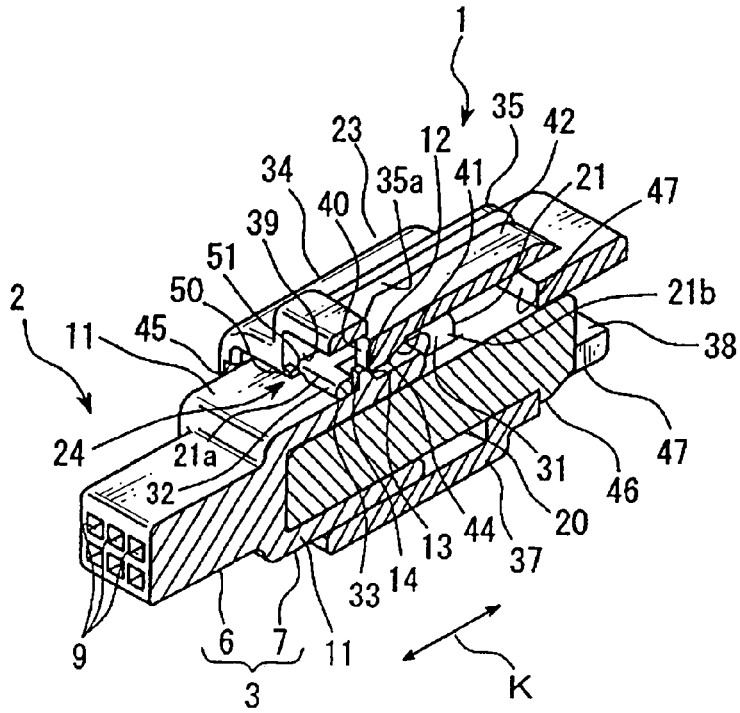
FIG. 8 is a perspective view showing a section taken on line VIII-VIII in FIG. 7.
Figure 10:
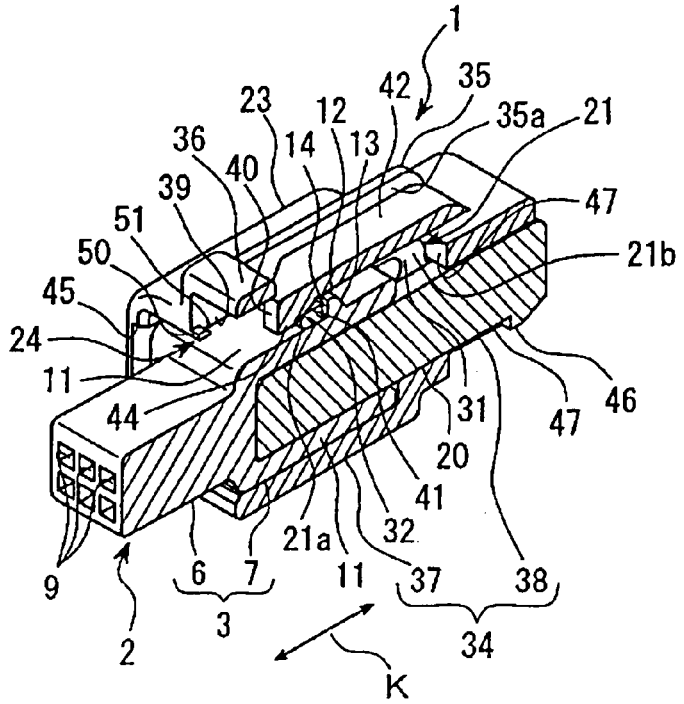
FIG. 10 is a perspective view showing a section taken on line X-X in FIG. 9.

As shown in FIG. 10, at the regulating position, the detecting projection 44 is positioned nearer the mating connector 2 than the locking beak 32 of the locking arm 21, and the detecting arm 42 is overlapped with the locking arm 21. As shown in FIG. 8, at the allowing position, the detecting projection 44 is positioned nearer the locking beak 32 than the mating connector 2, and the detecting arm 42 is overlapped with the locking arm 21. Guiding grooves 45 are formed on the inner wall of the lock securing member 23 for guiding a movement of the mating connector 2 in the connecting direction K.

Further, a preventing projection and a preventing notch 47 for preventing the lock securing member 23 from moving over the regulating position or the allowing position relative to the male housing 20, and a click projection 48 and a resiliently deformable arm for providing a click feeling with respect to a movement of the lock securing member 23 relative to the male housing 20 between the regulating position and the allowing position are formed on the inner wall of the lock securing member 23 and an outer wall of the male housing 20. "Providing a click feeling" means that holding the lock securing member 23 positioned at the regulating position at the regulating position, holding the lock securing member 23 positioned at the allowing position at the allowing position, and adding a resistance when the lock securing member 23 is moved between the regulating position and the allowing position.

Figure 4:
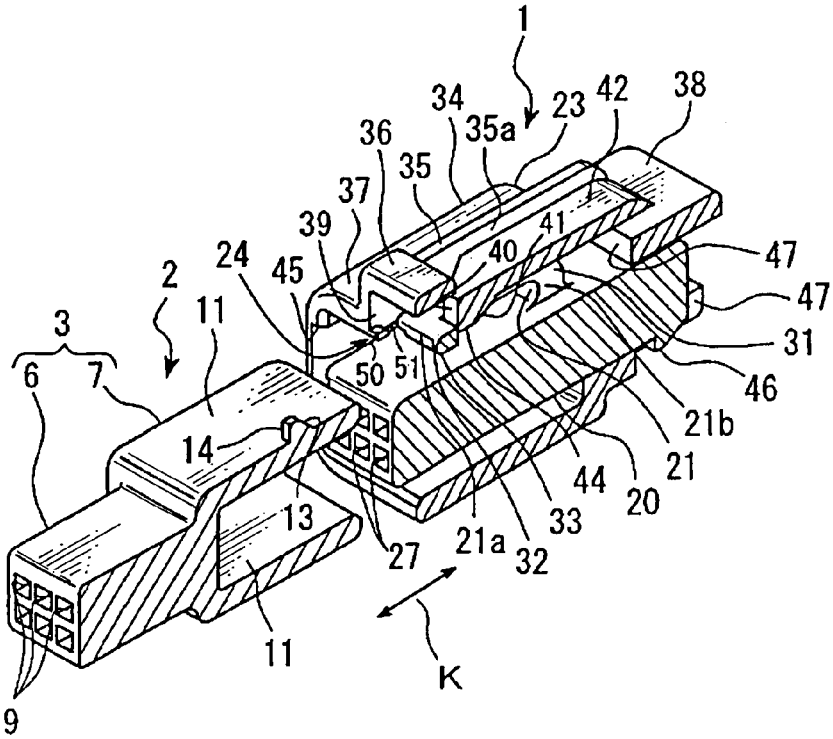
FIG. 4 is a perspective view showing a section taken on line IV-IV in FIG. 3.

Further, as shown in FIG. 4, at the allowing position, the detecting projection 44 of the detecting arm 42 is positioned away from the mating connector 2, and positioned between the pair of supporting arms 31 and the locking beak 32. Therefore, at the allowing position, the detecting projection 44 does not interfere with the locking beak 32, and the locking arm 21 is allowed to be resiliently deformed in a direction that the locking beak 32 gets away from the male housing 20. Namely, at the allowing position, the detecting arm 42 allows the locking arm 21 to be resiliently deformed, namely, to be engaged with the locking projection 12, and to be released with the engagement.

Further, at the allowing position, in a state that the locking beak 32 runs on the locking projection 12, the orthogonal wall 40 of the detecting projection 44 interferes with the locking beak 32 to prevent the lock securing member 23 from moving from the allowing position toward the regulating position. The state that the locking beak 32 runs on the locking projection 12 is referred to as an incomplete connection between the connector 1 and the mating connector 2, or as an incomplete engagement between the locking projection 12 and the locking arm 21.

Further, at the allowing position, in a state that the locking beak 32 runs over the locking projection 12, and is positioned between the locking beak 32 and the pair of supporting arms 31, the orthogonal wall 40 of the detecting projection 44 does not interfere with the locking beak 32, and the lock securing member 23 is allowed to move from the allowing position toward the regulating position. The state that the locking beak 32 runs over the locking projection 12 is referred to as a complete connection between the connector 1 and the mating connector 2, or as a complete engagement between the locking projection 12 and the locking arm 21.

Thus, when the engagement between the locking projection 12 and the locking arm 21 is complete, the lock securing member 23 becomes movable between the allowing position and the regulating position. Thus, when the connector 1 is connected to the mating connector 2, the lock securing member 23 is prevented from moving from the allowing position to the regulating position until the locking projection 12 and the locking arm 21 are completely engaged with each other.

Further, at the regulating position as shown in FIG. 10, the detecting projection 44 of the detecting arm 42 is nearer the mating connector 2 than the locking beak 32. Therefore, at the regulating position, the detecting projection 44 of the detecting arm 42 interferes with the locking beak 32 of the locking arm 21 to prevent the locking arm 21 from being resiliently deformed in a direction that the locking beak 32 gets away from the male housing 20. Namely, at the regulating position, the detecting arm 42 prevents the locking arm 21 from being resiliently deformed, namely, being engaged with the locking projection 12, and prevents the locking arm 21 from being released the engagement.

The lock releasing portion 24 includes a pair of releasing projections 50 which are respectively releasing portions. The releasing projection 50 projects from an edge of an inner wall 35*a* of the standing wall 35 close to both mating connector 2 and the male housing 20 in a direction that the standing walls 35 approach each other. Therefore, the lock releasing portion 24 is mounted on the lock securing member 23, and the pair of releasing projections 50 locate the one end 21*a* of the locking arm 21 therebetween. Incidentally, the inner walls 35*a* of the pair of standing walls 35 facing each other are inner walls of the notches 39 described in claims. Further, the releasing projections 50 are arranged with the locking arm 21 in a direction perpendicular to the connecting direction K.

Further, when the lock securing member 23 is positioned at the regulating position, the releasing projections 50 are arranged nearer the mating connector 2 than the one end 21*a* of the locking arm 21. Further, when the lock securing member 23 is moved from the regulating position to the allowing position (in an opposite direction of a moving direction to completely engage the locking projection 12 and the locking arm 21), the releasing projections 50 are disposed at a position where the releasing projections 50 are allowed to enter between the one end 21*a* of the locking arm 21 and the male housing 20. Namely, when the releasing projections 50 are moved in the opposite direction of a moving direction to completely engage the locking projection 12 and the locking arm 21, the releasing projections 50 are disposed at a position where the releasing projections 50 are allowed to enter between the one end 21*a* of the locking arm 21 and the male housing 20. Further, a slope wall 51 facing the one end 21*a* of the locking arm 21 when the lock securing member 23 is positioned at the regulating position is formed on the releasing projection 50. The slope wall 51 gradually slopes in a direction approaching an inside of the lock securing member 23, namely, a direction approaching the male housing 20 as the slope wall 51 gets away from the connector 2, namely, approaches the one end 21*a* of the locking arm 21.

When the lock securing member 23 is moved from the regulating position to the allowing position (in the opposite direction of a moving direction to completely engage the locking projection 12 and the locking arm 21), firstly, the releasing projections 50 contact the one end 21*a* of the locking arm 21. Then, because the releasing projections 50 is positioned at the above-described position, and the slope wall 51 slopes in the above-described direction, the releasing projections 50 enters between the male housing 20 and the one end 21*a* of the locking arm 21 in conjunction with the lock securing member 23 moving from the regulating position to the allowing position (in the opposite direction of a moving direction to completely engage the locking projection 12 and the locking arm 21).

Then, the releasing projections 50 of the lock releasing portion 24 resiliently deform the locking arm 21 to a position where the engagement with the locking projection 12 is released in a direction that the one end 21*a* gets away from the male housing 20. Thus, the releasing projections 50 of the lock releasing portion 24 release the engagement between the locking arm 21 and the locking projection 12 in conjunction with the movement of the lock securing member 23 from the regulating position to the allowing position (in the opposite direction of a moving direction to completely engage the locking projection 12 and the locking arm 21).

Figure 3:
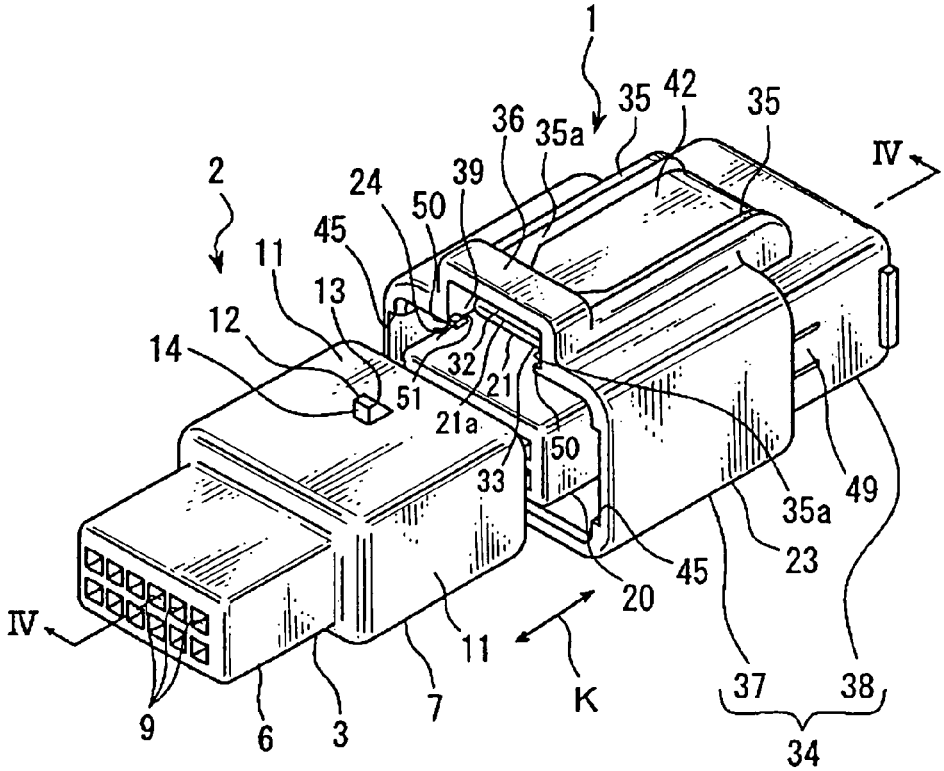
FIG. 3 is a perspective view showing the connector shown in FIG. 1 and a mating connector.
Figure 5:
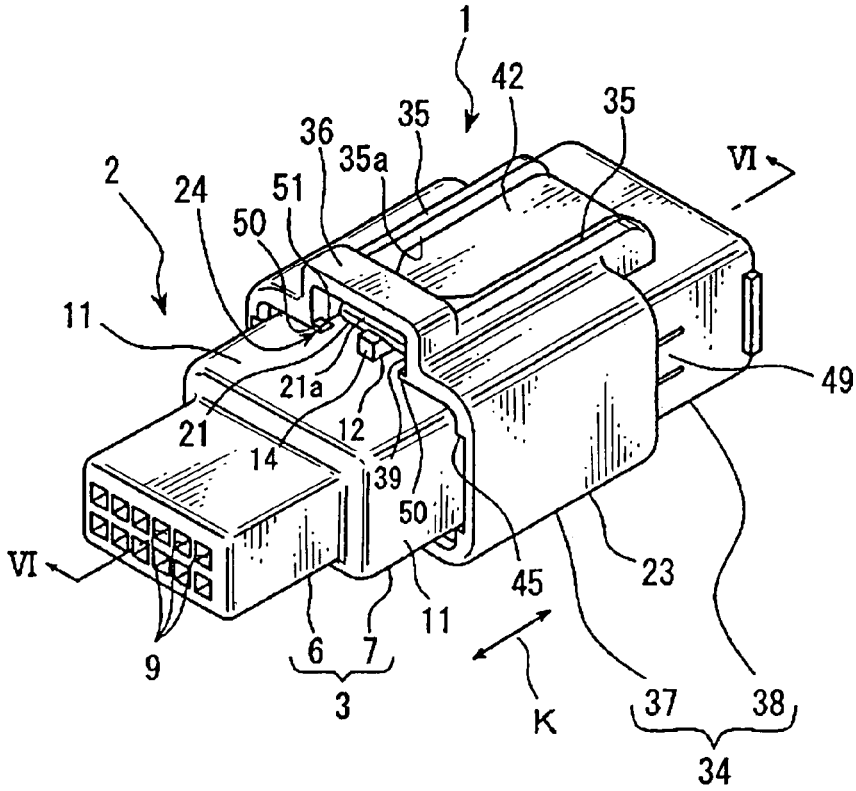
FIG. 5 is a perspective view showing the connector shown in FIG. 3 and the mating connector brought close to each other.
Figure 6:
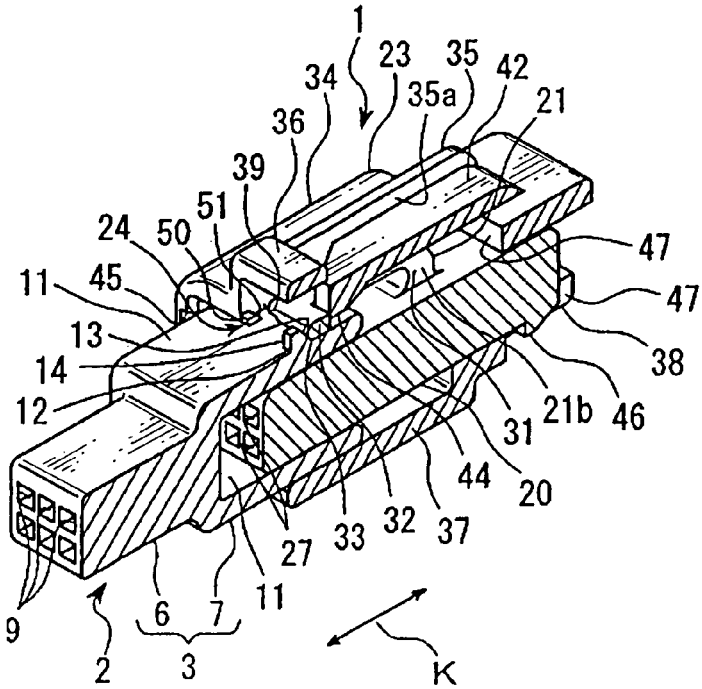
FIG. 6 is a perspective view showing a section taken on line VI-VI in FIG. 5.

For connecting the connector 1 to the mating connector 2, firstly, as shown in FIGS. 3 and 4, the lock securing member 23 is positioned at the allowing position, and faces the mating connector 2 with a gap. Then, the connector 1 is brought close to the connector 2. Then, as shown in FIGS. 5 and 6, the male housing 20 is inserted into the cover 7 of the mating connector 2, and the cover 7 is inserted into an outside of the male housing 20 and an inside of the lock securing member 23. Then, the locking beak 32 contacts the locking projection 12.

Figure 7:
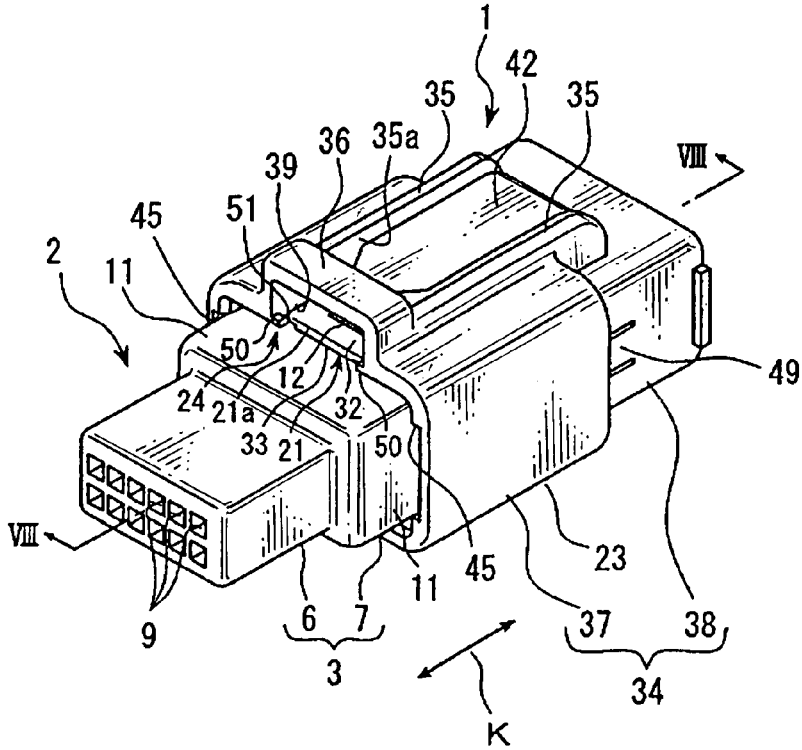
FIG. 7 is a perspective view showing a locking beak of a locking arm of the connector shown in FIG. 5 running over a locking projection of the mating connector.

Then, when the connectors 1, 2 are brought closer to each other, the locking beak 32 runs on the locking projection 12, and the locking arm 21 is resiliently deformed. Then, when the connectors 1, 2 are brought further closer to each other, the locking beak 32 runs over the locking projection 12, and the locking arm 21 is returned to a neutral state without deformation. Thus, as shown in FIGS. 7 and 8, the locking arm 21 is completely engaged with the locking projection 12. Then, the taper wall 13 of the locking projection 12 contacts the detecting projection 44 of the incomplete connection detecting arm 42.

Then, the lock securing member 23 is moved from the allowing position to the regulating position. Then, the detecting projection 44 runs on the locking projection 12 along the taper wall 13, and the detecting arm 42 is resiliently deformed.

Figure 9:
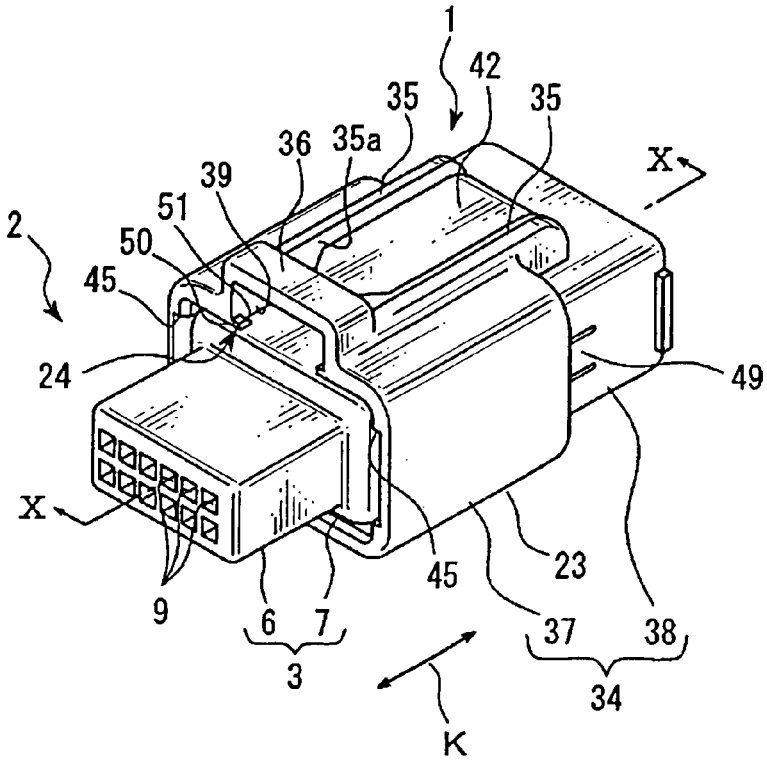
FIG. 9 is a perspective view showing a lock securing member of the connector shown in FIG. 7 positioned at a regulating position.

When the lock securing member 23 is further moved from the allowing position to the regulating position, as shown in FIGS. 9 and 10, the detecting projection 44 runs over both the locking projection 12 and the locking beak 32, the detecting arm 42 is returned to the neutral state without deformation, and the lock securing member 23 is positioned at the regulating position. Thus, the connector 1 is completely connected to the mating connector 2, and the lock securing member 23 is positioned at the regulating position.

When the connector 1 is separated from the mating connector 2 (when the engagement between the connectors 1, 2 is released), firstly, the lock securing member 23 positioned at the regulating position is moved toward the allowing position. Then, the detecting projection 44 is moved along the slope wall 41, the detecting projection 44 runs on the locking beak 32 and the locking projection 12 sequentially, and the detecting arm 42 is resiliently deformed.

Figure 11:
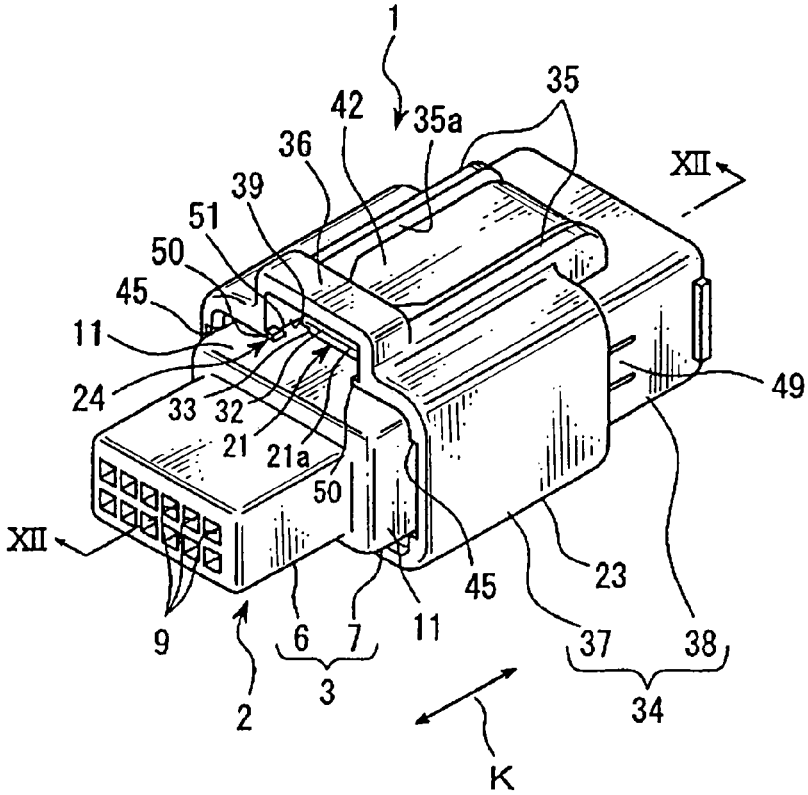
FIG. 11 is a perspective view showing the lock securing member of the connector shown in FIG. 9 being moved from the regulating position to an allowing position.
Figure 12:
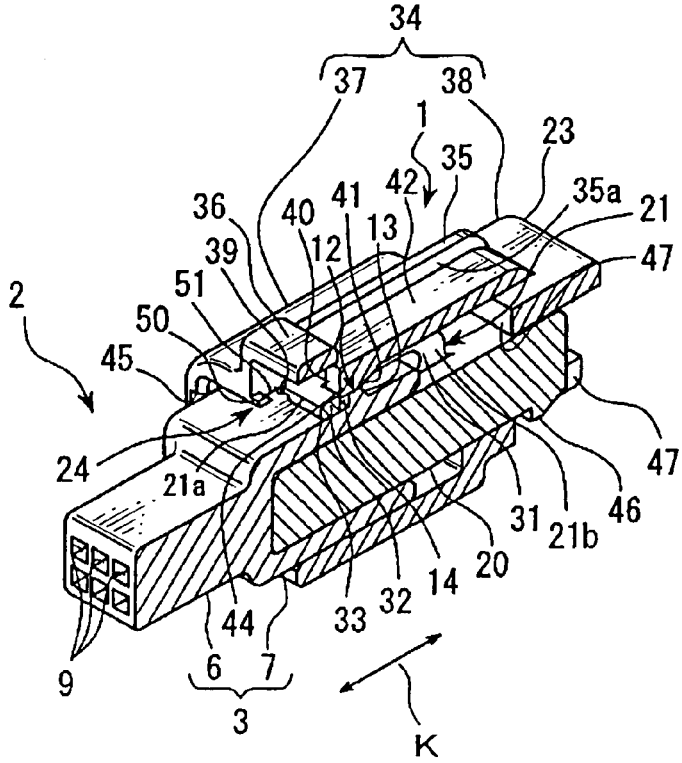
FIG. 12 is a perspective view showing a section taken on line XII-XII of FIG. 11.

Then, as shown in FIGS. 11 and 12, the releasing projections 50 of the lock releasing portion 24 gradually approach the one end 21*a* of the locking arm 21, namely, the locking beak 32. Then, when the detecting projection 44 of the detecting arm 42 is further removed from the connector 2 than the locking projection 12, the releasing projections 50 are inserted into between the locking beak 32 and the male housing 20 to release the engagement between the locking arm 21 and the locking projection 12. Thus, the engagement between the locking arm 21 and the locking projection 12 is completely released, the connection between the connectors 1, 2 is released, and the lock securing member 23 is positioned at the allowing position.

According to the present embodiment, because the lock releasing portion 24 for releasing the engagement between the one end 21*a* of the locking arm 21 and the locking projection 12 is mounted on the lock securing member 23 in conjunction with the movement of the lock securing member 23 from the regulating position to the allowing position, only moving the lock securing member 23 from the regulating position to the allowing position releases the connection to the mating connector 2.

Accordingly, pressing the other end 21*b* of the locking arm 21 is not necessary when releasing the connection to the mating connector 2. Therefore, it is not necessary to form a bending space for the other end 21*b* of the locking arm 21 between the lock securing member 23 and the male housing 20. Further, it is not necessary to make the mechanical strength of the locking arm 21 into the strength to sufficiently bear the pressing force. Accordingly, the bending space is not needed, and the locking arm 21 can be downsized, so that the connector 1 itself can be downsized.

Because the lock releasing portion 24 includes the releasing projections 50 which can be inserted into between the one end 21*a* of the locking arm 21 and the male housing 20 when the lock securing member 23 is moved from the regulating position to the allowing position, moving the lock securing member 23 from the regulating position to the allowing position surely releases the engagement between the one end 21*a* of the locking arm 21 and the locking projection 12. Therefore, it is not necessary to form a bending space for the other end 21*b* of the locking arm 21, and the locking arm 21 can be downsized, so that the connector 1 itself can be downsized.

The lock releasing portion 24 includes the pair of releasing projections 50 at a position where the locking arm 21 is positioned therebetween. Therefore, when the releasing projections 50 is inserted into between the one end 21*a* of the locking arm 21 and the male housing 20, the engagement between the one end 21*a* of the locking arm 21 and the locking projection 12 is surely released. Therefore, in the connector 1, moving the lock securing member 23 from the regulating position to the allowing position surely releases the engagement with the mating connector 2, and the connector 1 itself can be surely downsized.

Because the releasing projections 50 is formed on the inner wall 35*a* of the standing walls 35 as an inner wall of the notches 39 of the tubular main body 34 of the lock securing member 23, structures of the lock releasing portion 24 and the lock securing member 23 can be simple. Therefore, a producing process of the lock securing member 23 can be simple, and a cost of the connector 1 itself can be reduced.

Next, a connector 1 having a lock securing mechanism according to a second embodiment of the present invention will be explained with reference to FIGS. 13 to 15. Incidentally, portions similar to the first embodiment are identified by the same reference numerals and explanations thereof are omitted.

Figure 13:
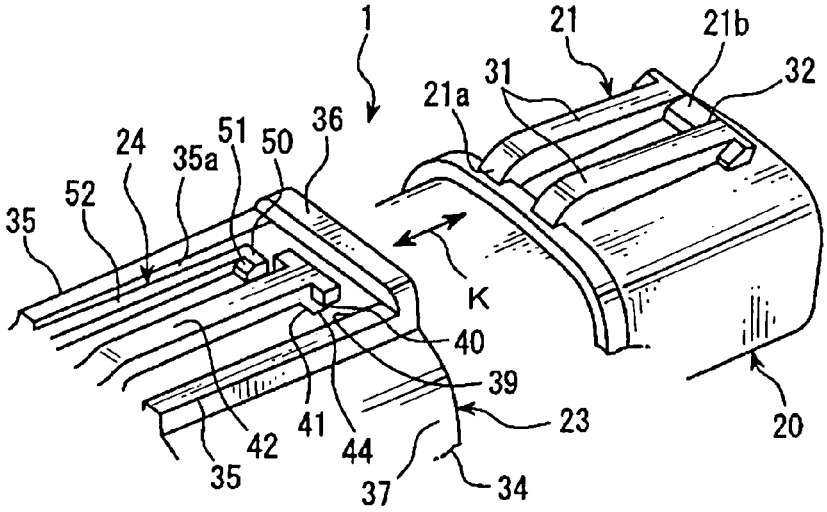
FIG. 13 is an exploded perspective view showing a main part of a connector according to a second embodiment of the present invention.
Figure 14:
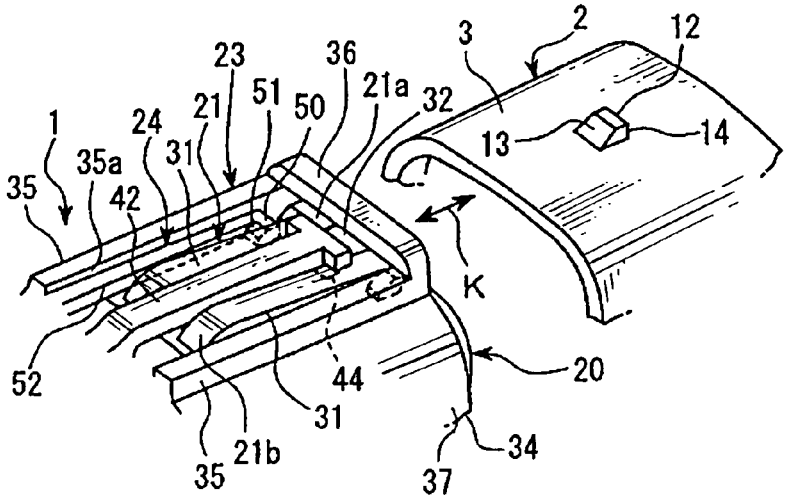
FIG. 14 is a perspective view showing a main part of the connector shown in FIG. 13 facing a mating connector.
Figure 15:
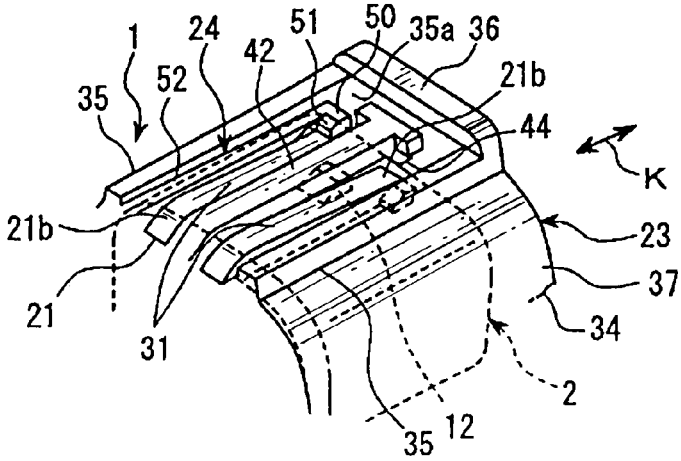
FIG. 15 is a perspective view showing a main part of the connector connected to the mating connector and the lock securing member positioned at the regulating position.

In the second embodiment, as shown in FIGS. 13 to 15, the lock releasing portion 24 includes a pair of releasing arms 52 (only one is shown in FIGS. 13 to 15), and the releasing projections 50. The locking arm 21 is positioned between the releasing arms 52. The releasing arms 52 extend in the connecting direction K. One end of each releasing arm 52 away from the mating connector 2 extends to the main body 34 of the lock securing member 23. The other end of each releasing arm 52 near the mating connector 2 is a free end. The releasing arms 52 are resiliently deformable. The releasing projections 50 are disposed at the other ends of the releasing arms 52.

In the second embodiment, similar to the first embodiment, in a condition that the connectors 1, 2 are fully connected to each other, when the lock securing member 23 is moved from the regulating position to the allowing position, the releasing projections 50 of the lock releasing portion 24 releases the engagement between the locking arm 21 and the locking projection 12. Thus, similar to the first embodiment, only moving the lock securing member 23 from the regulating position to the allowing position releases the engagement with the mating connector 2. Therefore, the bending space of the other end 21*b* of the locking arm 21 is not needed, and the locking arm 21 can be downsized, so that the connector 1 itself can be downsized.

In the embodiments described above, the releasing projections 50 as the releasing portion are formed on the lock securing member 23. However, according to the present invention, various structures can be used as the lock securing member 23. For example, a projection projecting outward in a width direction of the locking arm 21 (a direction perpendicular to the arrow K) may be formed on the locking arm 21, and a groove into which the projection can be inserted may be formed on the lock securing member 23.

Further, according to the embodiments described above, the notches 39 are formed on the main body 34 of the lock securing member 23. However, according to the present invention, it is not necessary to form the notches 39. In this case, the detecting arm 42 may be disposed inside the tubular main body 34, and the releasing projections 50 may project from an inner wall of the main body 34.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein. For example, the lock releasing portion 24 may include a single releasing projection 50.

As described above, according to the present invention described above, only moving the lock securing member releases the connection to the mating connector. Therefore, pressing the other end of the locking arm is not needed for releasing the connection to the mating connector. Therefore, it is not necessary to form a bending space at the other end of the locking arm. Further, it is not necessary to make the mechanical strength of the locking arm into the strength to sufficiently bear the pressing force. Accordingly, the bending space is not needed, and the locking arm can be downsized, so that the connector itself can be downsized.

According to the present invention described above, the lock releasing portion includes a releasing portion invadable between the one end of the locking arm and the connector housing when the lock securing member is moved. Therefore, moving the lock securing member surely releases the engagement between the one end of the locking arm and the engaging portion. Accordingly, the connector itself can be surely downsized.

According to the present invention described above, the releasing portion invading between one end of the locking arm and the connector housing surely releases the engagement between the one end of the locking arm and the engaging portion. Therefore, moving the lock securing member surely release the connection to the mating connector, and the connector itself can be surely downsized.

According to the present invention described above, the releasing portion is disposed at inner walls of the notches of the tube-shaped main body of the lock securing member. Therefore, structures of the lock releasing portion and the lock securing member can be simple. Accordingly, a process to produce the lock securing member becomes simple, and a cost of the connector itself can be reduced.

What is claimed is:

1. A connector comprising:

a connector housing for receiving terminal fittings;

a locking arm extended to the connector housing, an end of which is engaged with an engaging portion of a mating connector;

a lock securing member attached movably to the connector housing, said lock securing member regulating a movement thereof until the engaging portion and the locking arm are fully engaged with each other when the connector is connected to the mating connector, and allowing the movement after the engaging portion and the locking arm are fully engaged with each other, and a lock releasing portion mounted on an inner wall of the lock securing member for releasing the engagement between the locking arm and the engaging portion by moving only the lock securing member in a direction opposite to a direction of moving the locking arm and the engaging portion to be fully engaged with each other.

2. The connector as claimed in claim 1, wherein the lock releasing portion includes a releasing portion disposed at a position invadable between an one end of the locking arm and the connector housing when the lock securing member is moved in the direction opposite to the direction of moving the locking arm and the engaging portion to be fully engaged with each other.

3. The connector as claimed in claim 2, wherein the lock releasing portion includes a pair of the releasing portions disposed at a position where the locking arm is positioned between the releasing portions.

4. The connector as claimed in claim 3, wherein the lock securing member includes a main body formed in a tube shape for receiving the connector housing and having notches for positioning the locking arm inside of the main body, wherein the releasing portions are respectively disposed on inner walls facing each other of the notches.

* * * * *